US012497960B1

(12) United States Patent
Chen

(10) Patent No.: US 12,497,960 B1
(45) Date of Patent: Dec. 16, 2025

(54) FILTER DEVICE FOR AIR COMPRESSOR

(71) Applicant: DONGGUAN HESHENG MACHINERY & ELECTRIC CO., LTD., Dongguan (CN)

(72) Inventor: Chi-Wen Chen, New Taipei (TW)

(73) Assignee: DONGGUAN HESHENG MACHINERY & ELECTRIC CO., LTD., Dongguan (CN)

( * ) Notice: Subject to any disclaimer, the term of this patent is extended or adjusted under 35 U.S.C. 154(b) by 0 days.

(21) Appl. No.: 18/747,373

(22) Filed: Jun. 18, 2024

(51) Int. Cl.
*F04B 39/16* (2006.01)
*F04B 39/12* (2006.01)
*F04C 29/00* (2006.01)

(52) U.S. Cl.
CPC ..... *F04B 39/16* (2013.01); *F04B 39/121* (2013.01); *F04C 29/0092* (2013.01); *F04C 2280/00* (2013.01); *F04C 2280/04* (2013.01)

(58) Field of Classification Search
CPC .... F04B 39/16; F04B 39/121; F04C 29/0092; F04C 2280/00; F04C 2280/04
See application file for complete search history.

(56) References Cited

U.S. PATENT DOCUMENTS 2,176,691 A * 10/1939 Simons ..... F04B 39/16 417/454
3,111,259 A * 11/1963 Demay ..... F04B 39/16 417/360
4,371,322 A * 2/1983 Lorraine ..... F04C 15/06 417/313

FOREIGN PATENT DOCUMENTS

CN 112696336 A * 4/2021 ..... F04B 39/16

OTHER PUBLICATIONS

Korean Patent Publication and Machine Translation of KR 10-2024-0081758 A; 1st Inventor: Yeon; Title: Air Compressor For Vehicle; Published: Jun. 10, 2024 (Year: 2024).*
Korean Patent Publication and Machine Translation of KR 10-2017-0124903 A; 1st Inventor: Weon; Title: Linear Compressor; Published Nov. 13, 2017. (Year: 2017).*

* cited by examiner

*Primary Examiner* — Mary A Davis
(74) *Attorney, Agent, or Firm* — Leong C. Lei

(57) ABSTRACT

The filter device is applied to a small-size air compressor. The filter device includes a base member and a cover member. The base member has a back side and a front side. The back side is for sealing and connecting to a rear end of a driving motor of the air compressor. The front side is provided with a housing space surrounded with a side wall. The base member has multiple exhaust holes, allowing the housing space communicate with the driving motor's interior. At least one filtering material is placed inside the housing space. The cover member is joined to the base member to seal the housing space. The cover member is provided multiple air intake grooves. When the air compressor starts, external air is forcibly drawn through the air intake grooves, the at least one filtering material, and the exhaust holes into the driving motor.

5 Claims, 5 Drawing Sheets

FILTER DEVICE FOR AIR COMPRESSOR

BACKGROUND OF THE INVENTION

(a) Technical Field of the Invention

The present invention generally relates to air compressors, more particularly to a filter device integrated with a support stand for the driving motor of an air compressor.

(b) Description of the Prior Art

Air compressors or inflators are mainly used as a source of compressed air for pneumatic tools in workplaces or for general household repairs. They are also the primary equipment for inflating car tires or various inflatable objects.

Regarding the working principle of air compressors or inflators, they primarily operate by having an internal motor directly drive a crankshaft, causing it to rotate. This rotation then drives a connecting rod that makes the piston move up and down in a reciprocating motion, thereby changing the volume of the cylinder and compressing and discharging pressurized air. During the entire compression process, due to the change in cylinder volume, the compressed air passes through a one-way valve mechanism (check valve) and is output through an air nozzle via a hose, allowing it to inflate the desired object.

Observing conventional small to medium-sized air compressors or inflators (such as portable inflators or tabletop inflators), they are equipped with stands located at the front and rear positions of the air compressor. These stands ensure the stable placement of the air compressor. However, these conventional stands do not have any additional functions, and such air compressors lack filters for dust, grit, and moisture. Consequently, if moisture, grit, or dust in the air enters the cylinder of the air compressor or inflator, it inevitably causes wear between the piston and the cylinder wall. Furthermore, if moisture enters the cylinder, it will likely cause rust between the piston and the cylinder wall, significantly reducing the lifespan of the inflator.

Therefore, the main issue the present invention aims to solve is how to ingeniously convert the conventional stand, which is solely used for stabilizing the placement of air compressors or inflators, into a component that can filter dust, grit, and moisture from the external air. This innovation aims to effectively enhance the overall lifespan of the air compressor or inflator while considering manufacturing costs.

SUMMARY OF THE INVENTION

A major objective of the present invention is to provide a filter device for an air compressor, where the air compressor includes a driving motor and a cylinder assembly. The filter device includes a base member and a cover member. The base member has a back side and a front side. The back side of the base member is for sealing and connecting to a rear end of the driving motor. The front side of the base member is provided with a housing space surrounded with a side wall. The base member has multiple exhaust holes located on an interior bottom surface of the housing space. The exhaust holes communicate with the driving motor's interior. At least one filtering material is placed inside the housing space. The cover member is joined to the base member to seal the housing space. At least one side of the cover member is provided multiple air intake grooves. The air intake grooves correspond to the side wall of the housing space, creating gaps between the cover member and the side wall of the housing space, allowing external air to enter the housing space through the air intake grooves.

When the air compressor starts, external air will be forcibly drawn through the filter device, providing a forced air intake function. The external air passes through the air intake grooves, filtering material, and exhaust holes into the driving motor. At this point, the air inside the driving motor has been filtered and simultaneously cools the driving motor. The filtered air inside the driving motor is then conveyed out by the cylinder assembly as pressurized air.

The main technical feature of the present invention lies in the filter device's forming an integrated structure with the support stand of the air compressor that connects to the rear end of the driving motor of the air compressor. The filter device can effectively filter out dust, grit, and moisture from the air, effectively preventing these contaminants from entering the driving motor and cylinder assembly of the air compressor, which could otherwise cause damage and rust to the driving motor and cylinder assembly. This significantly enhances the lifespan of the air compressor, reduces manufacturing costs, and makes it suitable for various harsh environments (e.g., the air compressor can be used in deserts, on beaches, in high humidity like in rain forests, etc.).

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
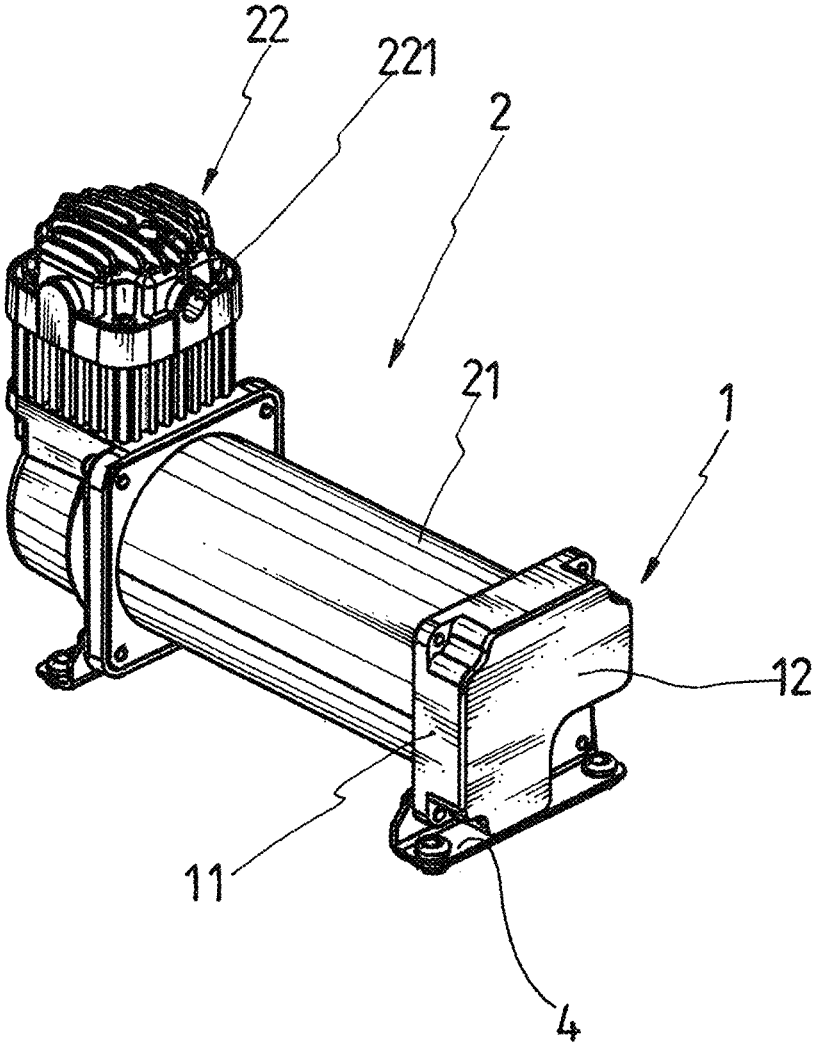
FIG. 1 is a perspective diagram showing a filter device according to an embodiment of the present invention mounted on an air compressor.
Figure 2:
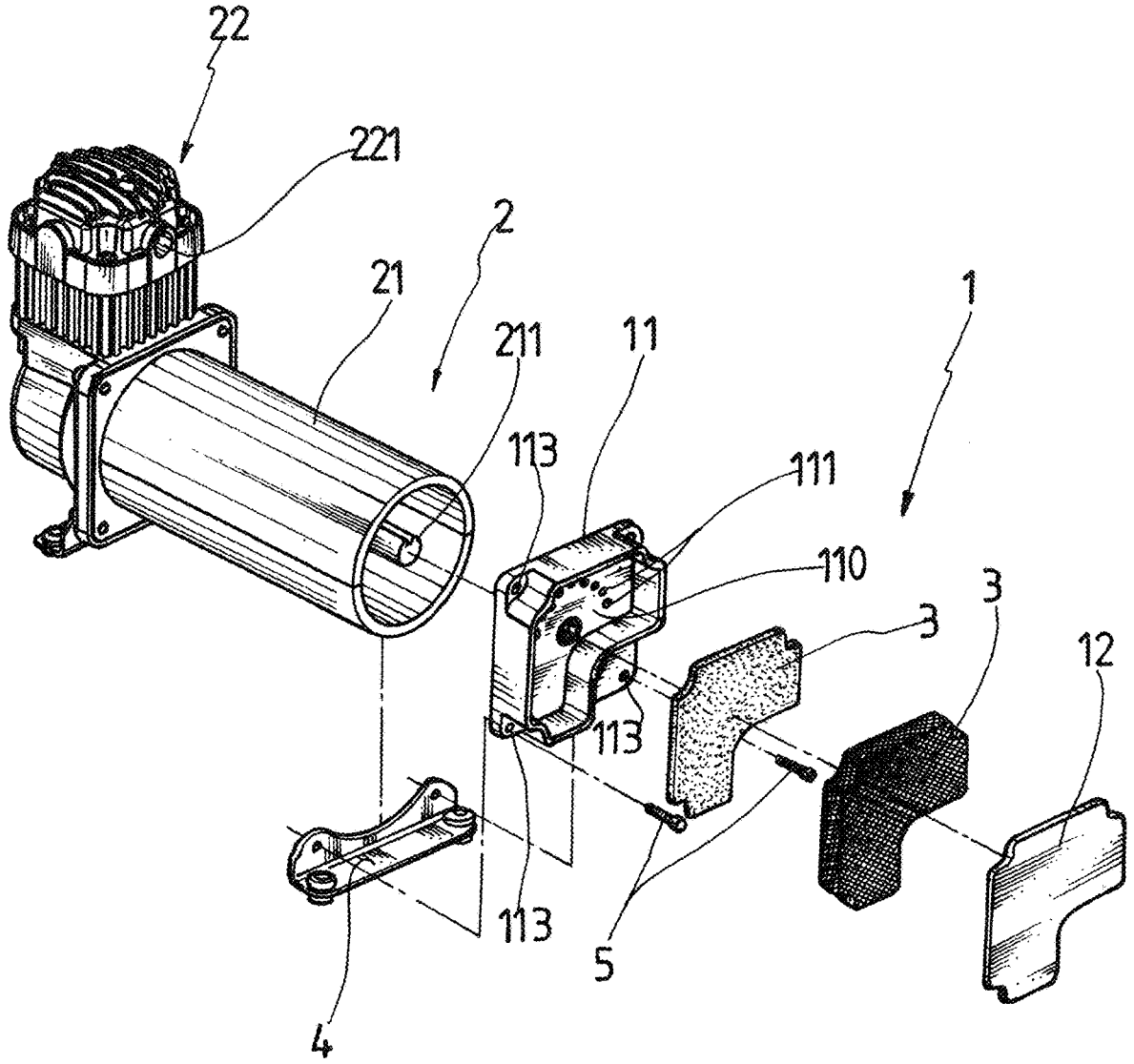
FIG. 2 is a perspective break-down diagram of the filter device of FIG. 1.
Figure 3:
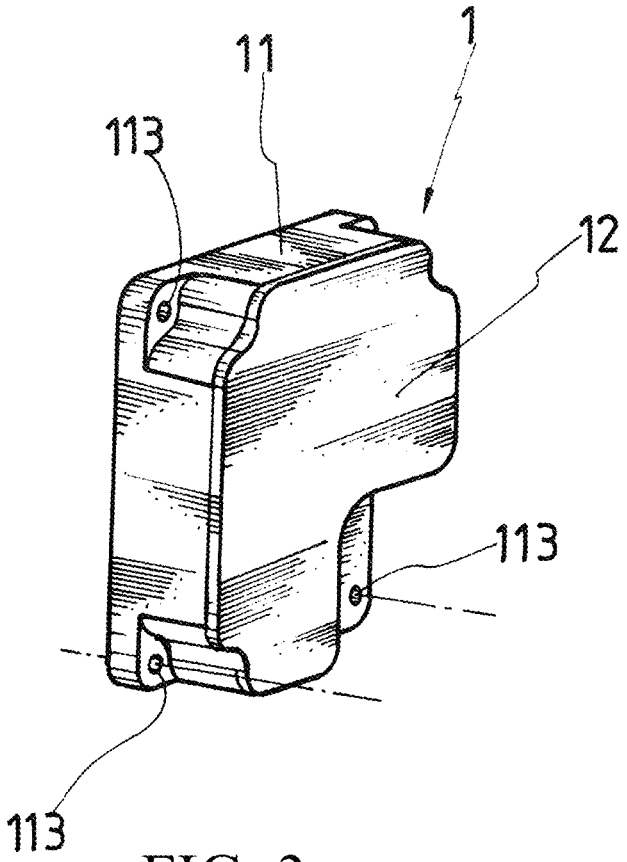
FIG. 3 is a perspective diagram showing the filter device of FIG. 1.

The following descriptions are exemplary embodiments only, and are not intended to limit the scope, applicability or configuration of the invention in any way. Rather, the following description provides a convenient illustration for implementing exemplary embodiments of the invention.

Various changes to the described embodiments may be made in the function and arrangement of the elements described without departing from the scope of the invention as set forth in the appended claims.

The filter device of the present invention is applied to a small-size air compressor carried with a vehicle or for DIY use. As shown in FIGS. 1 to 7, the filter device 1 according to an embodiment of the present invention is primarily integrated with a support stand 4 of the air compressor 2 and joins to the rear end of a driving motor 21 of an air compressor 2. The air compressor 2 includes at least one driving motor 21 and at least one cylinder assembly 22. The front end of the driving motor 21 is connected to the cylinder assembly 22. The cylinder assembly 22 is equipped with at least one air outlet 221, which allows the cylinder assembly 22, operated by the driving motor 21, to discharge compressed air from the air outlet 221. The various details of the air compressor 2, such as the gear set, connecting rod, and piston, are not the technical features of the present invention and therefore are not elaborated on here.

The filter device 1 includes a base member 11 and a cover member 12.

The base member 11 has a back side and a front side. The back side of the base member 11 is for sealing and connecting to the rear end of the driving motor 21. The front side of the base member 11 is provided with a housing space 110 surrounded with a side wall (not numbered). The base member 11 has multiple exhaust holes 111 located on the interior bottom surface of the housing space 110. These exhaust holes 111 communicate with the interior of the driving motor 21. Additionally, at least one or more filtering materials 3 are placed inside the housing space 110. When two or more types of filtering materials 3 are used, they can either be of the same material or of different materials.

Additionally, the base member 11 has multiple lock holes 113 around the outer periphery of the housing space 110. These multiple lock holes 113 are used to secure the base member 11 to a support stand 4 through multiple screws 5 for the stable placement of the air compressor 2.

Figure 4:
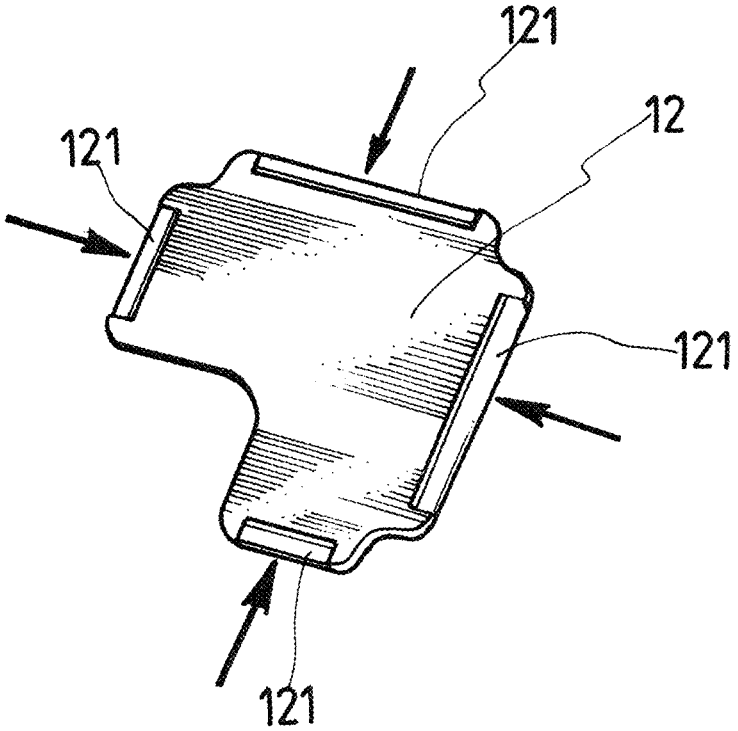
FIG. 4 is a perspective diagram showing a cover member of the filter device of FIG. 3.
Figure 5:
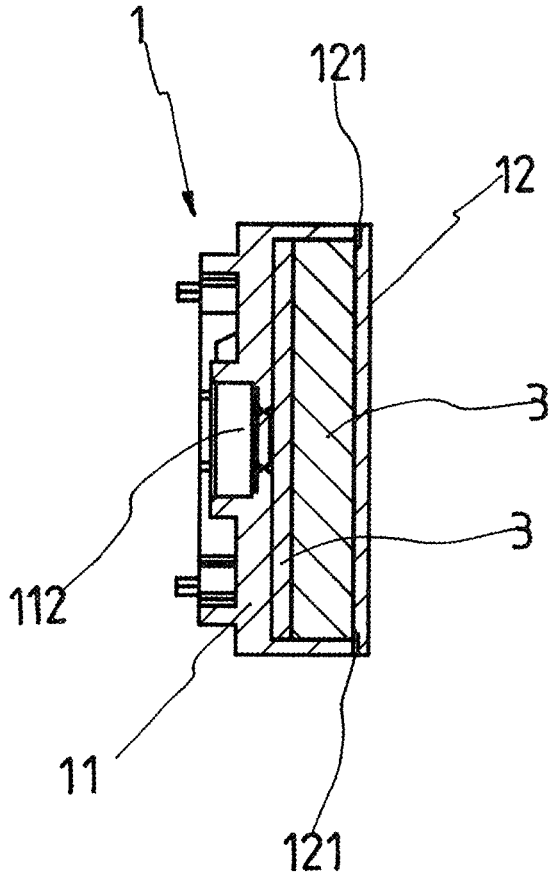
FIG. 5 is a sectional diagram showing the filter device of FIG. 3.
Figure 6:
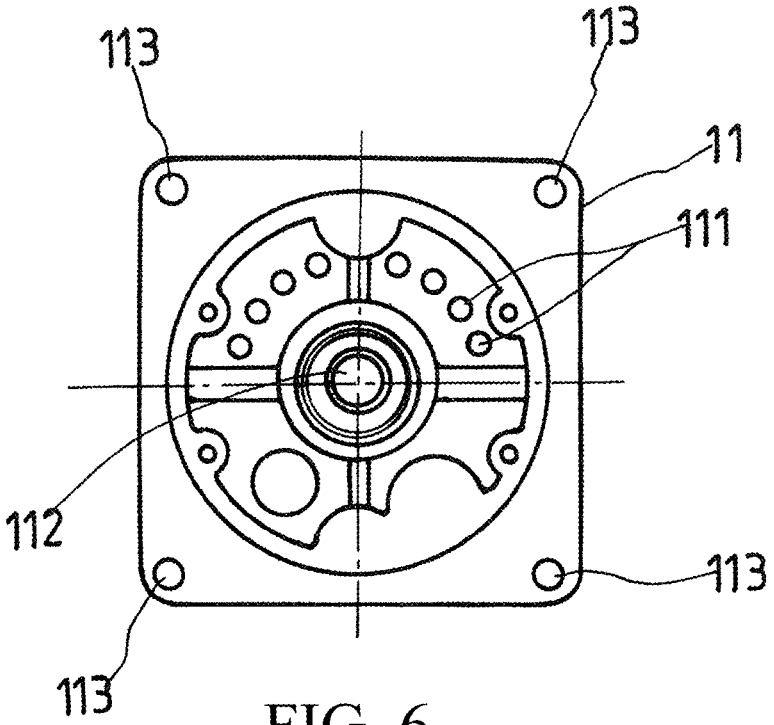
FIG. 6 is a rear-view diagram showing the back side of a base member of the filter device of FIG. 3.
Figure 7:
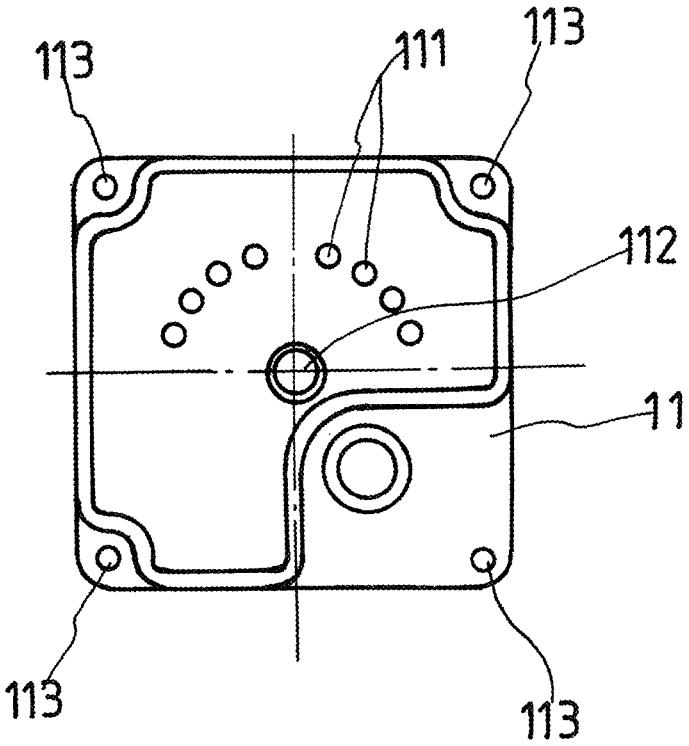
FIG. 7 is a front-view diagram showing the front side of a base member of the filter device of FIG. 3.

The cover member 12 is joined to the base member 11 to seal the housing space 110. At least one side of the cover member 12 is provided with multiple air intake grooves 121 (as shown in FIG. 4). The air intake grooves 121 correspond to the top of the side wall of the housing space 110, creating gaps between the cover member 12 and the side wall of the housing space 110 (as shown in FIG. 5), allowing external air to enter the housing space 110 through the air intake grooves 121.

The back side of the base member 11 is further provided with a shaft positioning seat 112. This shaft positioning seat 112 corresponds to the rotor shaft 211 of the driving motor 21, allowing the end of the rotor shaft 211 to be placed into the shaft positioning seat 112 to ensure the stable rotation of the rotor shaft 211.

As described above, when the air compressor 2 starts (i.e., when the driving motor 21 starts), external air will be forcibly drawn into the housing space 110 through the air intake grooves 121, providing a forced air intake function. The air then passes through one or more types of filtering material 3 for filtration. Finally, the filtered air enters the driving motor 21 through multiple exhaust holes 111. At this point, the air inside the driving motor 21 has been filtered and simultaneously cools the driving motor 21. The filtered air inside the driving motor 21 is then conveyed out through the air outlet 221 by the cylinder assembly 22 as pressurized air. In this way, using the filtering material 3 installed in the base member 11 can effectively filter out dust, grit, and moisture from the air, preventing them from entering the driving motor 21 and cylinder assembly 22 of the air compressor 2, which could otherwise cause wear, damage, and rusting of the driving motor 21 and cylinder assembly 22.

Therefore, the main technical feature of the present invention lies in the filter device 1's forming an integrated structure with the support stand 4 of the air compressor 2 that connects to the rear end of the driving motor 21 of the air compressor 2. The filter device 1 can effectively filter out dust, grit, and moisture from the air, effectively preventing these contaminants from entering the driving motor 21 and cylinder assembly 22 of the air compressor 2, which could otherwise cause damage and rust to the driving motor 21 and cylinder assembly 22. This significantly enhances the lifespan of the air compressor 2, reduces manufacturing costs, and makes it suitable for various harsh environments (e.g., the air compressor can be used on beaches, by the sea, in high humidity, etc.).

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A filter device for an air compressor, where the air compressor comprises a driving motor and a cylinder assembly, the filter device comprising:

a base member having a back side and a front side, where the back side of the base member is for sealing and connecting to a rear end of the driving motor, the front side of the base member is provided with a housing space surrounded with a side wall, the base member has a plurality of exhaust holes located on an interior bottom surface of the housing space, the exhaust holes communicate with the driving motor's interior, at least one filtering material is placed inside the housing space; and a cover member joined to the base member to seal the housing space, where at least one side of the cover member is provided a plurality of air intake grooves, the air intake grooves correspond to the side wall of the housing space, creating gaps between the cover member and the side wall of the housing space, allowing external air to enter the housing space through the air intake grooves;

wherein, when the air compressor starts, external air is forcibly drawn through the air intake grooves, the at least one filtering material, and the exhaust holes into the driving motor; and wherein the side wall of the base member that surrounds the housing space has a top surface, and wherein the at least one side of the cover member defines an inside surface that faces and is placed in contact engagement with the top surface of the side wall of the base member, the inside surface of the cover member having a periphery corresponding to the top surface of the side wall of the base member, the inside surface of the cover member being recessed along a plurality of separate sections of the periphery of the inside surface to form a plurality of recessed peripheral sections alternating with un-recessed peripheral sections of the periphery, so as to define the plurality of air intake grooves alternating with the un-recessed peripheral sections, wherein the un-recessed peripheral sections are in contact engagement with the top surface of the side wall of the base member, and the recessed peripheral sections are spaced from the top surface of the side wall of the base member to form the gaps between the cover member and the side wall of the base member.

2. The filter device according to claim 1, wherein, when there are two or more filtering materials, the filtering materials are of the same material.

3. The filter device according to claim 1, wherein, when there are two or more filtering materials, the filtering materials are of different materials.

4. The filter device according to claim 1, wherein the base member has a plurality of lock holes around the housing space's outer periphery; and these lock holes are used to secure the base member to a support stand of the air compressor through a plurality of screws.

5. The filter device according to claim 1, wherein the back side of the base member is provided with a shaft positioning seat; the shaft positioning seat corresponds to a rotor shaft of the driving motor, allowing an end of the rotor shaft to be placed into the shaft positioning seat.

* * * * *